United States Patent [19]

Blatt

[11] Patent Number: 4,553,444

[45] Date of Patent: Nov. 19, 1985

[54] RETRACTOR MECHANISM FOR ARTICLE TRANSFER APPARATUS

[76] Inventor: Leland F. Blatt, 31915 Groesbeck Hwy., Fraser, Mich. 48026

[21] Appl. No.: 542,746

[22] Filed: Oct. 17, 1983

[51] Int. Cl.[4] ..... F16H 21/44

[52] U.S. Cl. ..... 74/110; 74/89.12; 308/6 R

[58] Field of Search ..... 74/29, 89.12, 110, 422, 74/89.15; 308/6 R

[56] References Cited

U.S. PATENT DOCUMENTS

| | | | |
|---|---|---|---|
| 3,365,005 | 1/1968 | Berkoben et al. | 308/6 R |
| 3,665,771 | 5/1972 | Blatt | 74/89.12 |
| 3,742,774 | 7/1973 | Blatt | 74/89.15 |

*Primary Examiner*—James C. Yeung

*Attorney, Agent, or Firm*—Cullen, Sloman, Cantor, Grauer, Scott, & Rutherford

[57] ABSTRACT

In a multiple stroke retractor mechanism for an article transfer apparatus having an elongated body and a pair of tracks mounting a reciprocal carriage, with opposed rack gears upon the body and carriage, a power reciprocated pinion carrier and longitudinally spaced opposed pairs of pinions journaled upon the carrier in mesh with the rack gears, the improvement comprising improved pinion carrier of channel from having side plates, longitudinally spaced laterally opposed pairs of first and second cam followers journaled upon the side plates upon horizontal and vertical axes supportably mounted upon and bearing against the sides of the tracks for constraining reciprocal movements of the carrier to unit horizontal and vertical planes. A modified carrier similarly mounted upon the tracks includes longitudinally spaced pairs of pulleys and timing belts supported upon the carrier and connected with the carriage, replacing the rack gears and pinions.

10 Claims, 11 Drawing Figures

RETRACTOR MECHANISM FOR ARTICLE TRANSFER APPARATUS

BACKGROUND OF THE INVENTION

Heretofore, an elongated housing upon a suitable support mounted parallel spaced tracks upon which was reciprocally supported a carriage adapted to mount a gripping tool for transferring workpieces into and out of a machine tool as for example, a press or stamping die. Opposed rack gears were mounted upon the housing and the carriage. A power reciprocated pinion carrier included a plurality of pairs of laterally spaced pinions in mesh with the respective rack gears so that reciprocation of the pinion carrier effected corresponding reciprocal movements of the carriage. The problem existed of supporting and guidably mounting the pinion carrier so that its reciprocal movements were constrained to a single horizontal plane and to a single vertical plane.

THE PRIOR ART

Applicant's U.S. Pat. No. 3,665,771 of May 30, 1972 directed to a stroke multiplying retractor mechanism is illustrative of the prior art wherein power reciprocated movements of a pinion carrier and pinions with respect to a pair of opposed racks effected reciprocal movements of a carriage.

Applicant's U.S. Pat. No. 3,742,774 dated July 3, 1973 directed to an adjustable stroke retractor mechanism represented an improvement particularly in the use of an adjustable shock absorber for regulating the stroke of the reciprocal carriage and for absorbing kinetic energy from said carrier before a reversal of direction thereof.

RELATED PATENT APPLICATION

An improved electro servo drive shuttle unit is shown in Applicant's copending patent application, Ser. No. 284,559 filed July 20, 1981 where controlled reciprocal movements of the pinion carrier are effected by a motor operated lead screw with remote electronic controls.

SUMMARY OF THE INVENTION

An important feature of the present invention is to provide an improved pinion carrier wherein an elongated body upon a suitable support and a power reciprocated pinion carrier guidably mounted thereon are constructed of extruded aluminum and wherein a pair of heat treated hardened steel tracks are mounted and supported upon the body along its length.

A further feature includes a guide mounting of the carriage upon the tracks and a guide mounting of the pinion carrier upon the same tracks.

A further feature includes longitudinally spaced pairs of laterally opposed bearing blocks mounted upon the carriage including journaled therein a plurality of right angularly related cam followers guidably and operatively engageable with the top, bottom and outer side of the respective tracks for guided reciprocal movements of the carriage.

A further feature includes a pinion carrier of channel form having side plates upon which are mounted longitudinally spaced laterally opposed pairs of pinions and wherein the pinion carrier has mounted thereon longitudinally spaced laterally opposed pairs of cam followers journaled upon horizontal and vertical axes respectively and in operative supported engagement upon the corresponding tracks and the interior surfaces thereof for constraining reciprocal movements of the pinion carrier to single, horizontal and vertical planes.

A further feature includes an improved shock absorber construction adjustably and slidably mounted upon the tracks together with a manually operable adjustable screw selectively positioning the shock absorber for regulating the stroke of the reciprocal pinion carrier.

A further feature includes an improved carrier for an article transfer apparatus which omits the rack gears and pinions. Replacing them there are provided upon the carrier longitudinally spaced laterally opposed pairs of pulleys mounting continuous timing belts on opposite sides of the carrier, with the timing belts connected to the carriage so that reciprocal movements of the carrier effect corresponding reciprocal movements of the carriage.

A further feature of the present invention includes a plurality of longitudinally spaced laterally opposed pairs of right angularly related cam followers mounted upon pinion carrier upon opposite sides thereof and adapted to engage the top and bottom of the respective tracks and the interior surfaces thereof for constraining reciprocal movements of the pinion carrier with respect to the track.

These and other objects and features will be seen from the following Specification and claims in conjunction with the appended drawings.

THE DRAWINGS

FIGS. 1 and 1*a* are fragmentary side elevational views of the present carrier mechanism for a transfer apparatus.

FIGS. 2 and 2*a* are plan views thereof.

Figure 6:
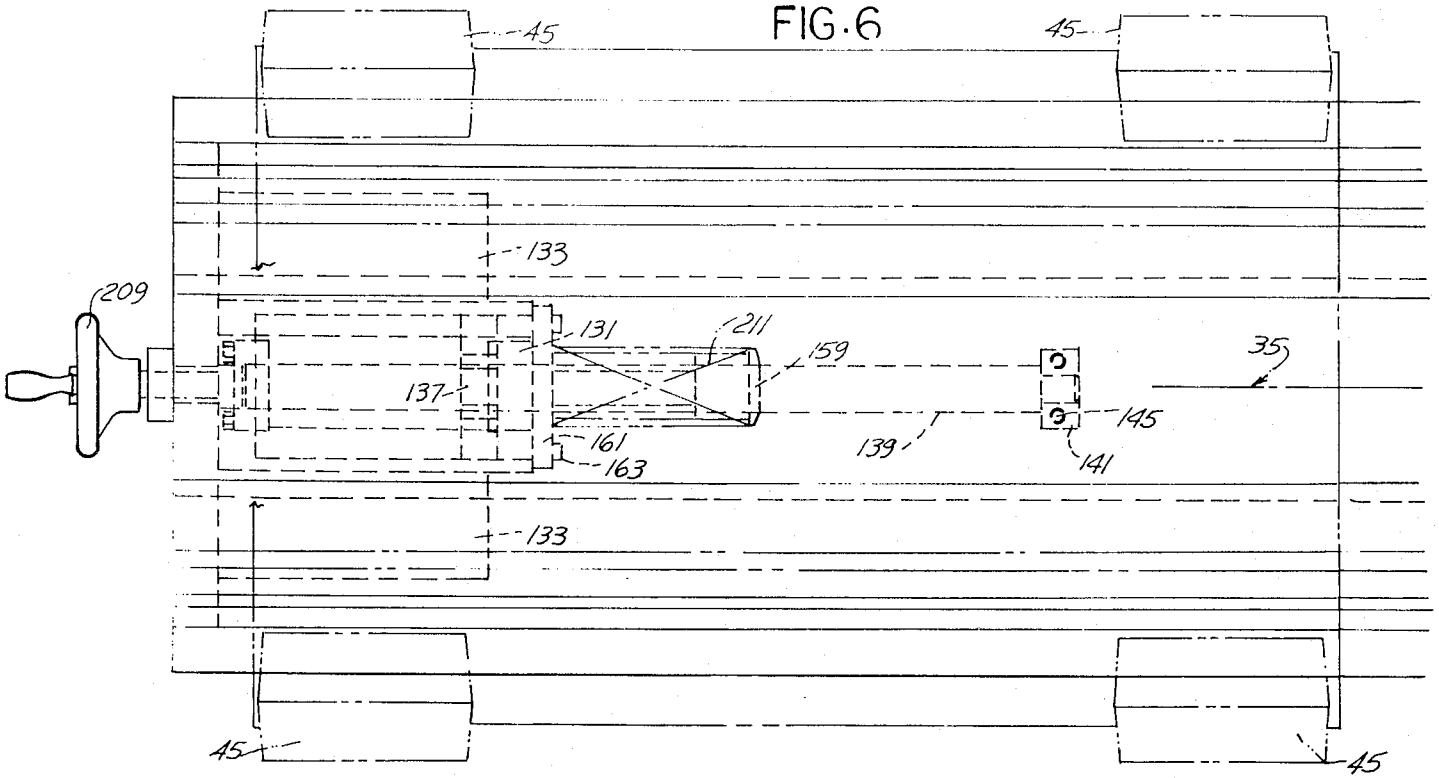
Figure 5:
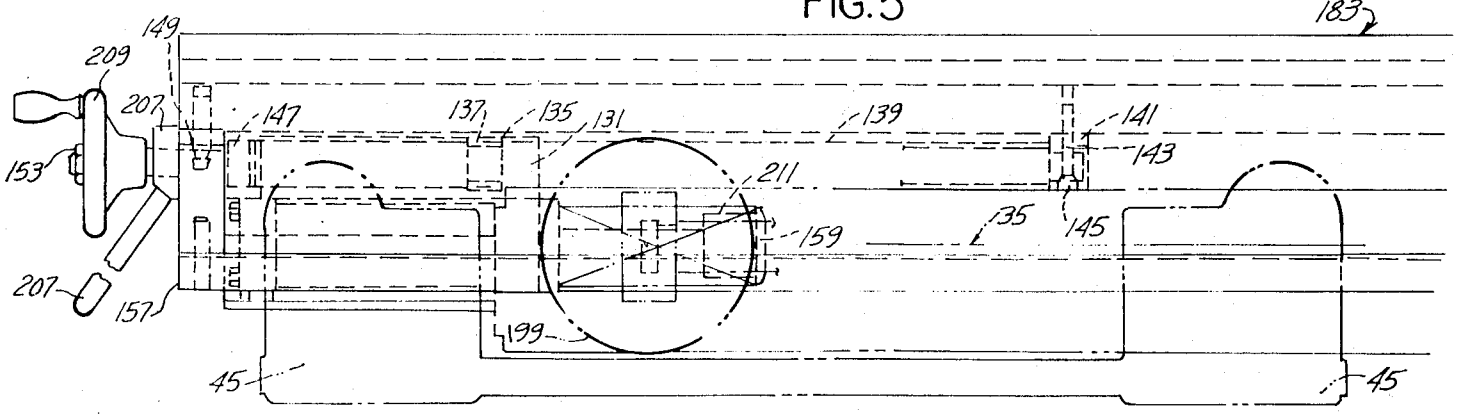
Figures 5A, 6A:
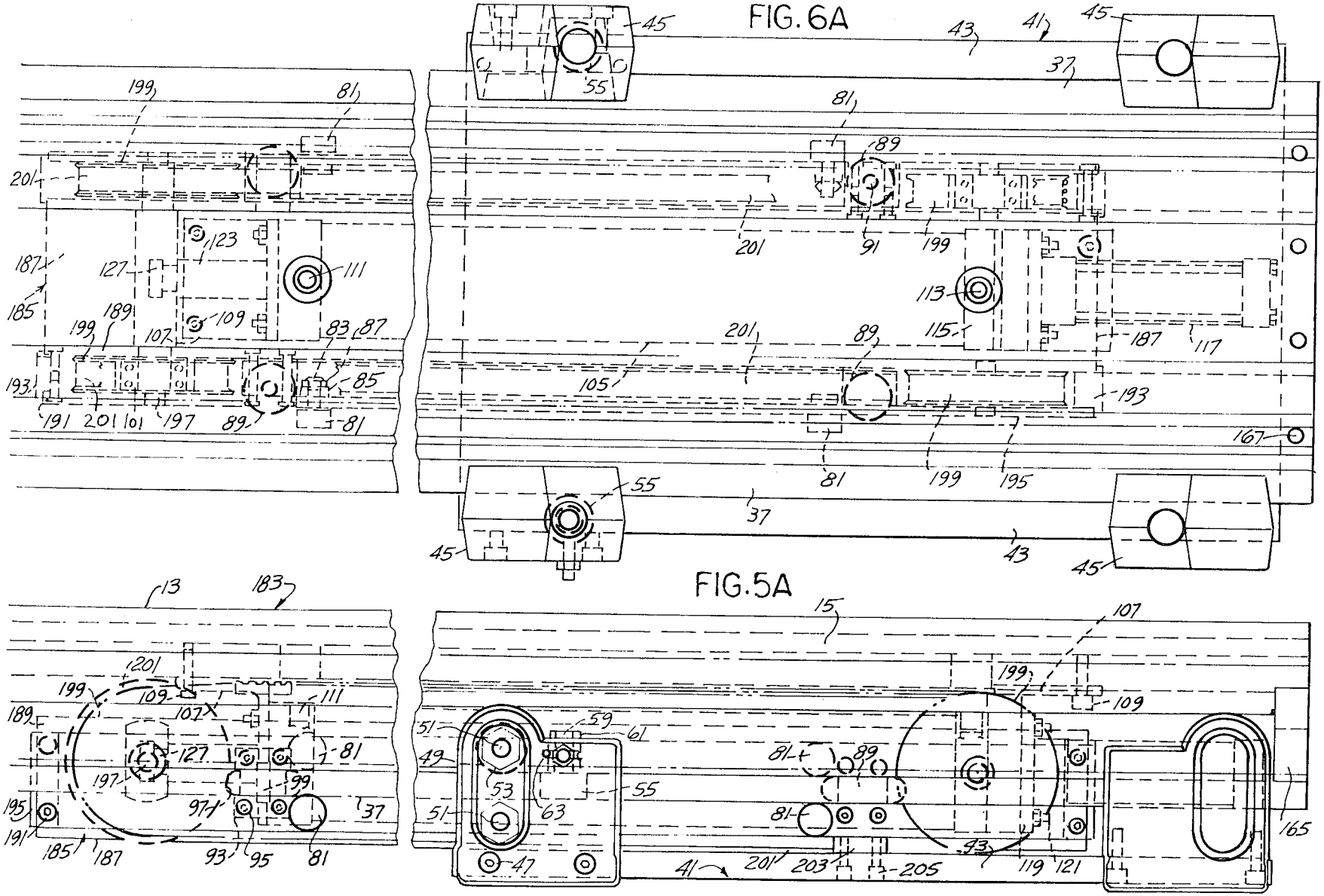

FIGS. 5 and 5*a* are fragmentary side views of a further modified retractor mechanism.

FIGS. 6 and 6*a* are plan views thereof.

Figure 7:
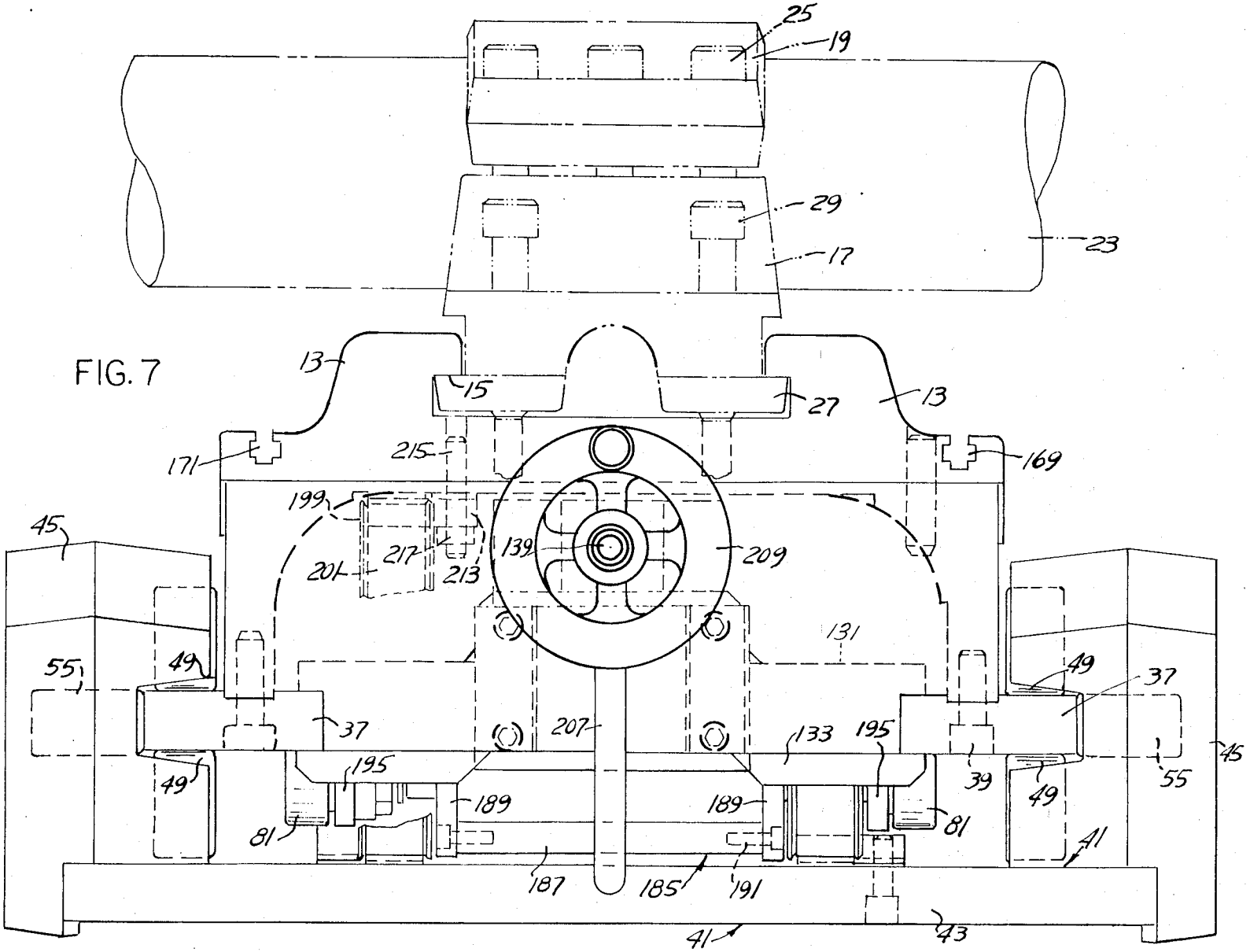

FIG. 7 is an end view thereof on an increased scale.

It will be understood that the above drawings illustrate merely preferred embodiments of the invention and that other embodiments are contemplated within the scope of the claims hereafter set forth.

DETAILED DESCRIPTION OF AN EMBODIMENT OF THE INVENTION

Referring to drawings, FIGS. 1, 1*a*, 2, 2*a* and 3, the present shuttle assembly for a multiple stroke retractor mechanism is generally indicated at 11 and includes an elongated body 13 formed of extruded aluminum. Elongated T-slot 15 extends along the top of body 13 and is adapted to receive a pair of longitudinally spaced shuttle hanger brackets 17 which depend from a suitable support. Each bracket includes bracket caps 19 which together define bore 21 within which is positioned the transverse support tube 23, fragmentarily shown, and adjustably secured in position by fasteners 25. Each hanger bracket includes a depending T-flange 27 adjustably nested within T-slots 15 and secured thereto by fasteners 29.

Mounted upon and along the length of the body are a pair of parallel spaced rack gears 31 secured thereto by fasteners 33 and spaced equally upon opposite sides of longitudinal axis 35.

A pair of laterally spaced parallel tracks 37, made of heat treated or hardened steel, are equally spaced from opposite sides of said axis and secured to the undersurfaces of the side walls of the corresponding body by a plurality of fasteners 39. Each track has a longitudinal slot which receives said side walls.

Reciprocal carriage 41 includes an elongated carriage plate 43 which has mounted thereon upon its opposite sides, longitudinally spaced laterally opposed pairs of bearing blocks 45 secured thereto by fasteners 47. The opposed interior sides of the respective bearing blocks are recessed at 57 in order to extend over and receive adjacent portions of the corresponding tracks.

Figure 3:
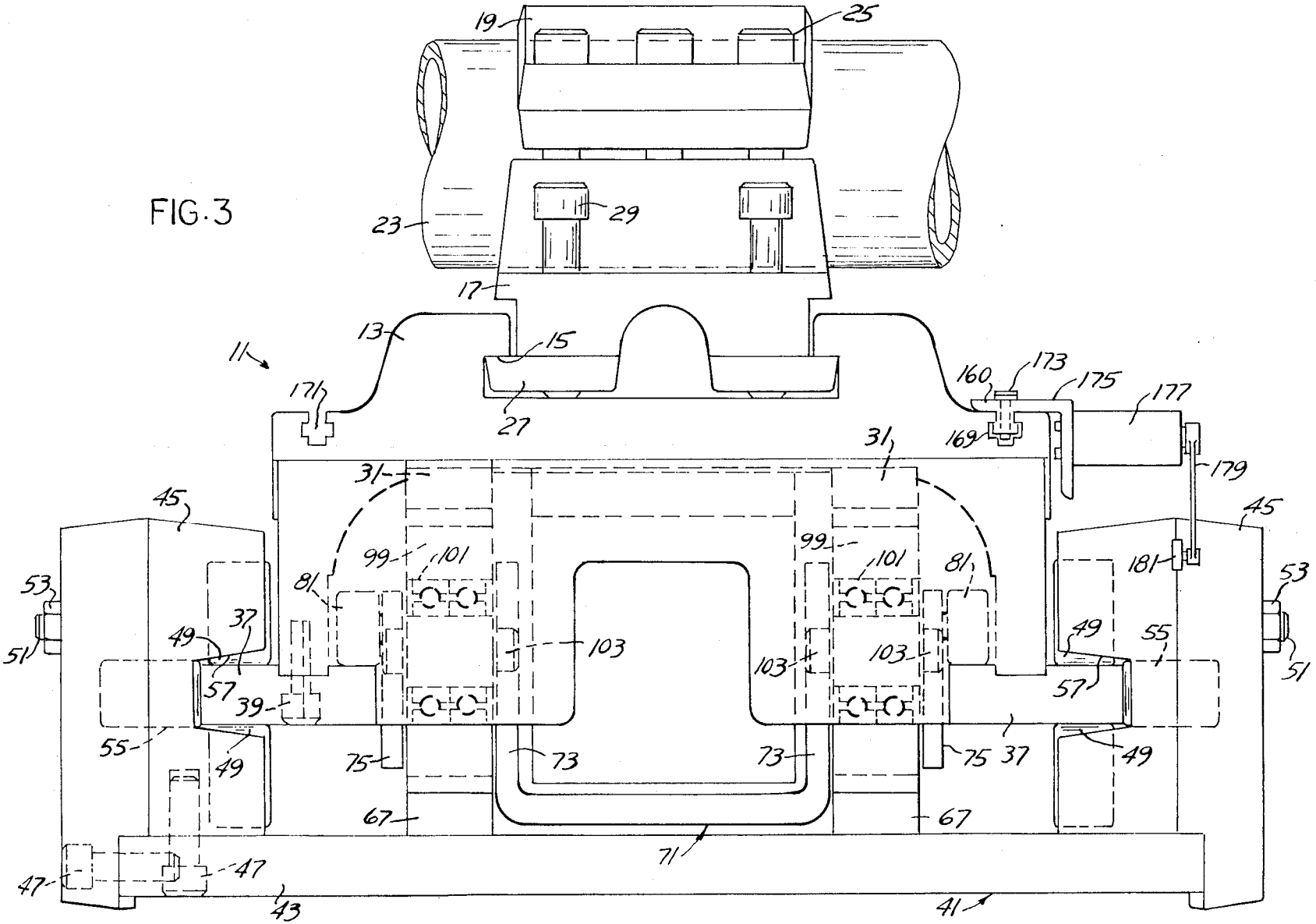
FIG. 3 is an end elevational view thereof on an increased scale.

Within each of the bearing blocks there is mounted a first cam follower 49 journaled upon the shaft 51 upon a horizontal axis, threaded at its outer end and receiving an anchor nut 53, FIG. 3. A second cam follower 49 is positioned within the bearing block spaced from the first cam follower, journaled upon a shaft 51 upon a parallel axis, threaded at one end, which projects through the bearing block and is secured thereto by a nut 53.

The first cam follower is adapted to supportably engage the top surface of track 37. The second cam follower is adapted to retainingly engage the undersurface of track 37.

Figures 1, 2:
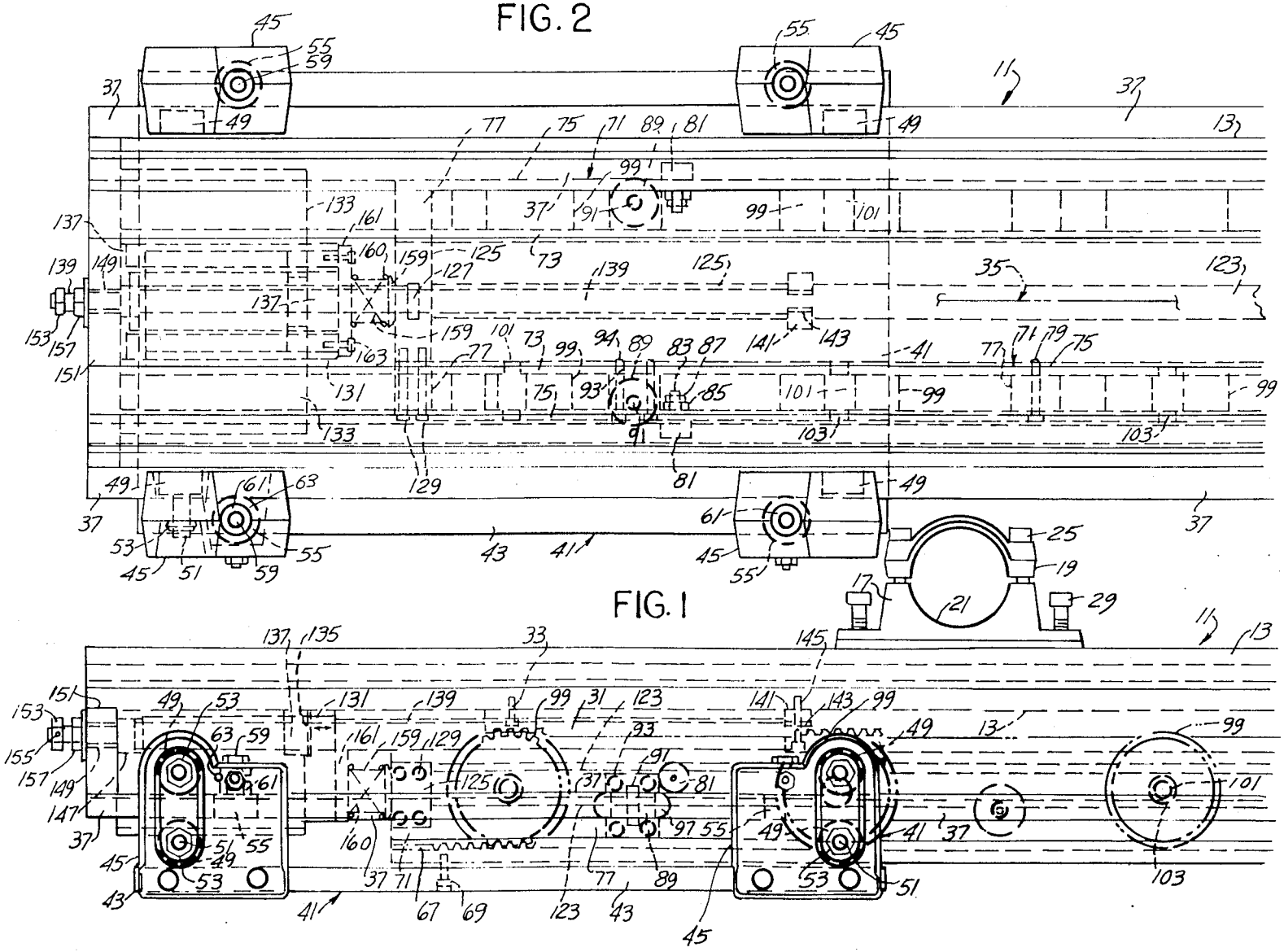
Figure 2A:
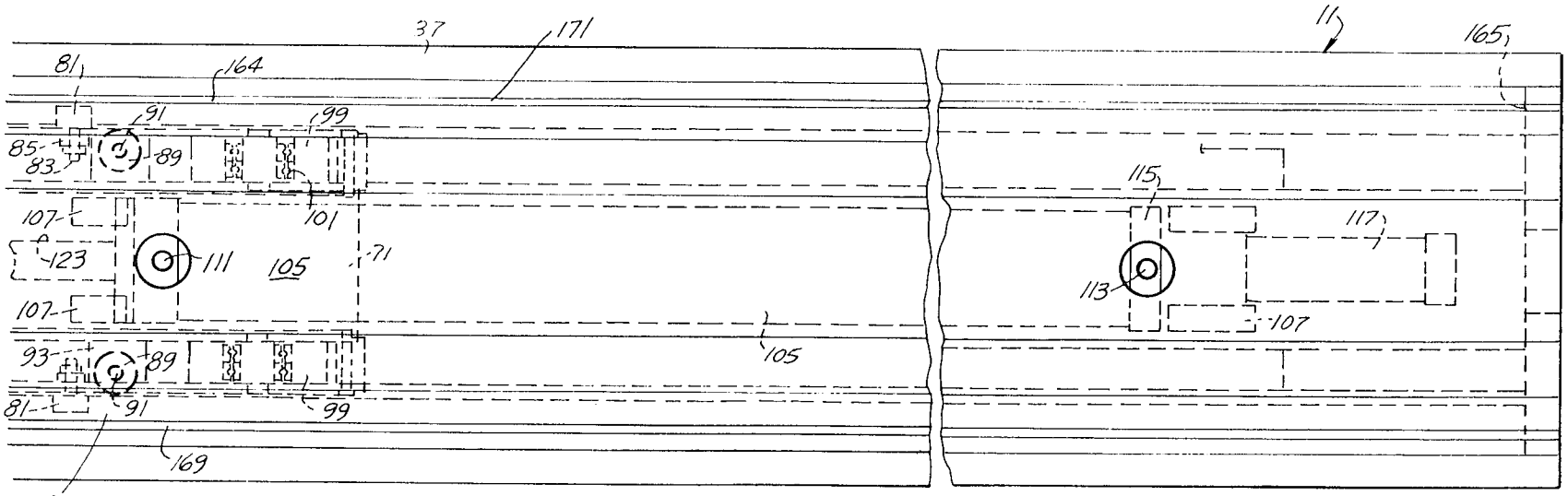
Figure 1A:
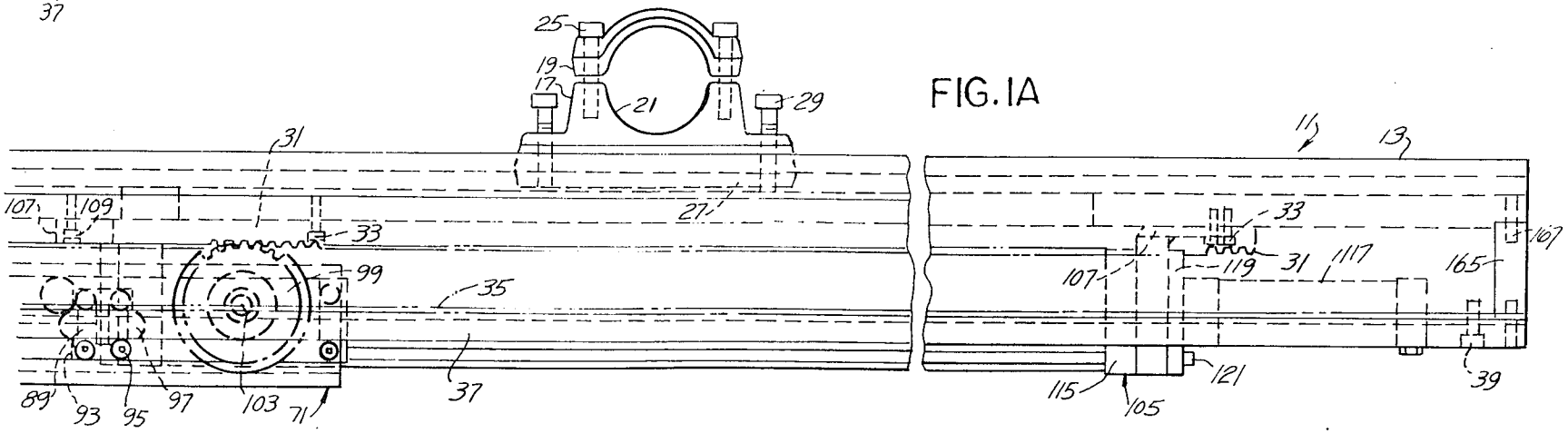

A third cam follower 55 is additionally positioned within said bearing block journaled upon roller shaft 59, arranged upon a vertical axis within the eccentric bushing 61, FIGS. 1 and 2. The bushing in each bearing block is nested within a corresponding bushing retainer 63 which is retained in position with respect to the bearing block by an eccentric bushing set screw.

A pair of laterally spaced parallel rack gears 67 are mounted upon the carriage plate 43 and secured thereto by fasteners 69. The rack gears 67 are uniformly spaced upon opposite sides of the body longitudinal axis 35. Rack gears 67 are in registry with and opposed to the corresponding body rack gears 31.

Power reciprocated pinion carrier 71 of channel form includes a pair of upright parallel first side plates 73. Spaced outwardly from each of said side plates are upright parallel second side plates 75 with intermediate spacers 77, secured together by a plurality of fasteners 79, FIG. 2.

Longitudinally spaced laterally opposed pairs of first cam followers 81 are each journaled upon a shaft 83, arranged on a horizontal axis which extends through side plates 75, through spacer 85 and secured thereto by fastener 87. Cam followers 81 are adapted for cooperative supported engagement with the top inner surfaces of the tracks 37 FIG. 3.

Longitudinally spaced laterally opposed pairs of second cam followers 89 are each journaled upon a shaft 91 upon a vertical axis supported within the shaft mount plates 93 spanning side plates 73 and 75 and secured thereto by the fasteners 95. The cam followers 89 extend through corresponding recesses 97 within side plates 75 and are adapted for operative retaining and guided engagement with the interior upright sides of the corresponding tracks 37, FIGS. 1 and 2.

Longitudinally spaced laterally opposed pairs of pinions 99 having bearings 101 are journaled upon the transverse shafts 103 which span the carrier side plates 73 and 75 with said pinions interposed between said side plates. The pinions are in mesh with the body rack gears 31 at all times. One or a pair of said pinions are in mesh at all times with the corresponding rack gears 67 upon carriage plate 43.

A power operated reciprocal means effects corresponding reciprocal movements of pinion carrier 71. In the illustrative embodiment, there is employed an air cylinder 105 having at its opposite ends, cylinder mount plates 107 which bear against upper portions of the body 13 and are secured thereto by fasteners 109. Air fittings 111 and 113 upon respective heads of the cylinder are adapted to alternately receive and deliver pressurized air against a reciprocal piston within said cylinder which includes an axial piston rod 123 which projects therefrom.

In the manner well known in the art, the corresponding ports 111, 113 are pressurized alternately for effecting reciprocal movements of the piston and piston rod under the control of a valve in an automatic fashion. It is contemplated as equivalent, that the power means could be a hydraulic cylinder or the power means could be rotative feed screw journaled upon the elongated body and threaded through a nut upon the pinion carrier for effecting timed reciprocal movements thereof. Such power means as an equivalent construction, is shown in applicant's copending patent application upon an electric servo drive shuttle unit, Ser. No. 284,559, filed July 20, 1981. The disclosure therein to the extent that it shows an equivalent mechanism for reciprocating the piston carrier utilizing a lead screw is incorporated by reference as an equivalent, remote controlled power means for reciprocating the piston carrier.

Shock absorber 117 has an upright mount flange 119 secured by fasteners 121 to the blind end head 115 of power cylinder 105. The shock absorber is a conventional construction such as disclosed at 86 and 88 in the U.S. Pat. No. 3,665,771. The resilient cushion assembly or shock absorber 117 is disposed along the central axis 35 and may be a fluid cushion or mechanical spring bumper of conventional design. The operational characteristics of the shock absorber or fluid cushion assembly 117 and its particular construction forms no part of the present invention, except as an element in the combination and further description is omitted.

The projecting end of piston rod 123, FIG. 2, is secured to the transverse rod end 125 upon one end of the pinion carrier by the T-slot connection 127 and fasteners 129.

As shown in FIGS. 1 and 2, adjustable shock absorber unit 131, sometimes referred to as a shock mount, includes a pair of laterally directed side plates 133 which are slidably mounted upon one end of the tracks 37. Within a transverse slot 135 in the shock absorber mount 131 there is positioned a nonrotative nut 137 which is stationary and through which is threaded the adjusting screw 139. One end of the adjusting screw is journaled within the bronze bearing 143 upon the screw mount 141 secured to body 13 by fasteners 145. The other end of the adjusting screw extends through spacer 147 and through bushing 149 within end plate 151 which is adjustably mounted at one end of the body 13. Portions of the adjusting screw are projected outward thereof.

Jamb nut 153 upon the end of the adjusting screw is retained thereon by the pin 155. Rotation of the jamb nut 153 effects rotation of the adjusting screw selectively for effecting longitudinal adjustments of the shock absorber slide mount 131.

Additional Jam nut 157 is threaded upon adjusting screw 139 and in the properly adjusted positioned of the shock absorber 159 is rotated to retainingly engage end plate 151 for securing the adjusting screw in the preselected position. The resilient shock absorber 159 projects from the adjustable shock absorber slide mount 131 and is normally biased outwardly by the coiled compression spring 160. Mount plate 161 for shock absorber 159 is secured to the shock mount slide 131 by fasteners 163.

Extending around the top of the body 13 upon one side thereof is the undercut T-slot 169. Said slot is adapted to receive the bolt 173 which is connected to bracket 175 for limit switch 177. Said limit switch has a depending pivot arm 179 and a contact roller 181 adapted for registry with reciprocal carriage 41. Accordingly, a pair of longitudinally adjustable spaced limit switches are normally mounted adjacent opposite ends of the T-slot 169. This would provide a means by which an automatic valve control mechanism can be reversed electronically determining the reciprocal feed movements of the pinion carrier, for illustration.

An additional undercut elongated T-slot 171 is formed along the opposite side of the body 13 at the top thereof parallel to T-slot 169. The secondary T-slot 171 provides a means by which a power track may be suspended and adjustably secured along the length of body 13.

MODIFIED SHUTTLE ASSEMBLY

FIGS. 5, 5*a*, 6, 6*a* and 7 illustrate the modified shuttle assembly 183 which is of a construction similar to the shuttle assembly described with respect to FIGS. 1, 2 and 3. Common structures to FIGS. 1, 2 and 3 are not repeated.

The primary difference in this modification is the construction of a shuttle assembly which includes a pulley carrier 185 which replaces the use of the rack gears and pinions above described with respect to FIGS. 1, 2 and 3. The remainder of the construction is the same. Namely, there is employed an elongated body mounting tracks 37 upon which a carriage 41 is reciprocally mounted utilizing longitudinally spaced laterally opposed bearing blocks 45 and cam followers 49 and 55. Likewise, the pulley carrier 185 is of channel shape and includes elongated base plate 187 and a pair of opposed side plates 189 secured to the base plate by fasteners 191.

Spaced outwardly of side plates 189 are corresponding outer side plates 195 with intermediate side plate mount blocks 193 secured thereon by fasteners 191. Interposed between the respective side plates 189 and 195, upon opposite sides of the carrier 185 are longitudinally spaced laterally opposed pairs of pulleys 199 journaled on shafts 197 which extend between the respective side plates adjacent opposite ends of carrier 185. Each of the pulleys has an internal bearing assembly 101 similar to the pinions 99 above described with respect to FIGS. 1, 2 and 3.

Upon opposite sides of the pulley carrier 185 and extending between corresponding pulleys 199 are a pair of timing belts 201. It is considered equivalent that the timing belts be replaced by cables and correspondingly shaped pulleys.

As shown in FIG. 5*a*, a portion of one of the timing belts 201 receives the belt hold-down block 203 bears against a portion of the carriage plate 43 of carriage 41 and is secured thereto by fasteners 205. As shown in FIG. 7, a portion of the corresponding other timing belt is secured to an adjacent portion of the elongated body 13 by a corresponding shuttle body hold down block 213 and fasteners 215 employing suitable jam nuts 217.

As shown in FIG. 7, shock absorber assembly 131, 159 is similar to that above described with respect to FIG. 3, except that the adjusting screw has thereon a handle 209 instead of jam nut 153.

As a modification of the slide mounting for the pulley carrier, there is provided in addition to the above described cam followers 81 which bear against the top of track 37, an additional set of longitudinally spaced laterally opposed pairs of cam followers 81. These are rotatable upon horizontal axes and are adapted to operatively engage the undersurface of track 37. Thus, the cam followers upon the side plates 189 of the pulley carrier 185 engage both the top and bottom of the corresponding tracks 37 as well as the upright interior surfaces thereof for constraining reciprocal movements of the pulley carrier to single horizontal and vertical planes. The additional cam followers 81 may be applied to pinion carrier 71, FIGS. 1 and 2.

MODIFIED TRACK AND BEARING BLOCK ASSEMBLY

Figure 4:
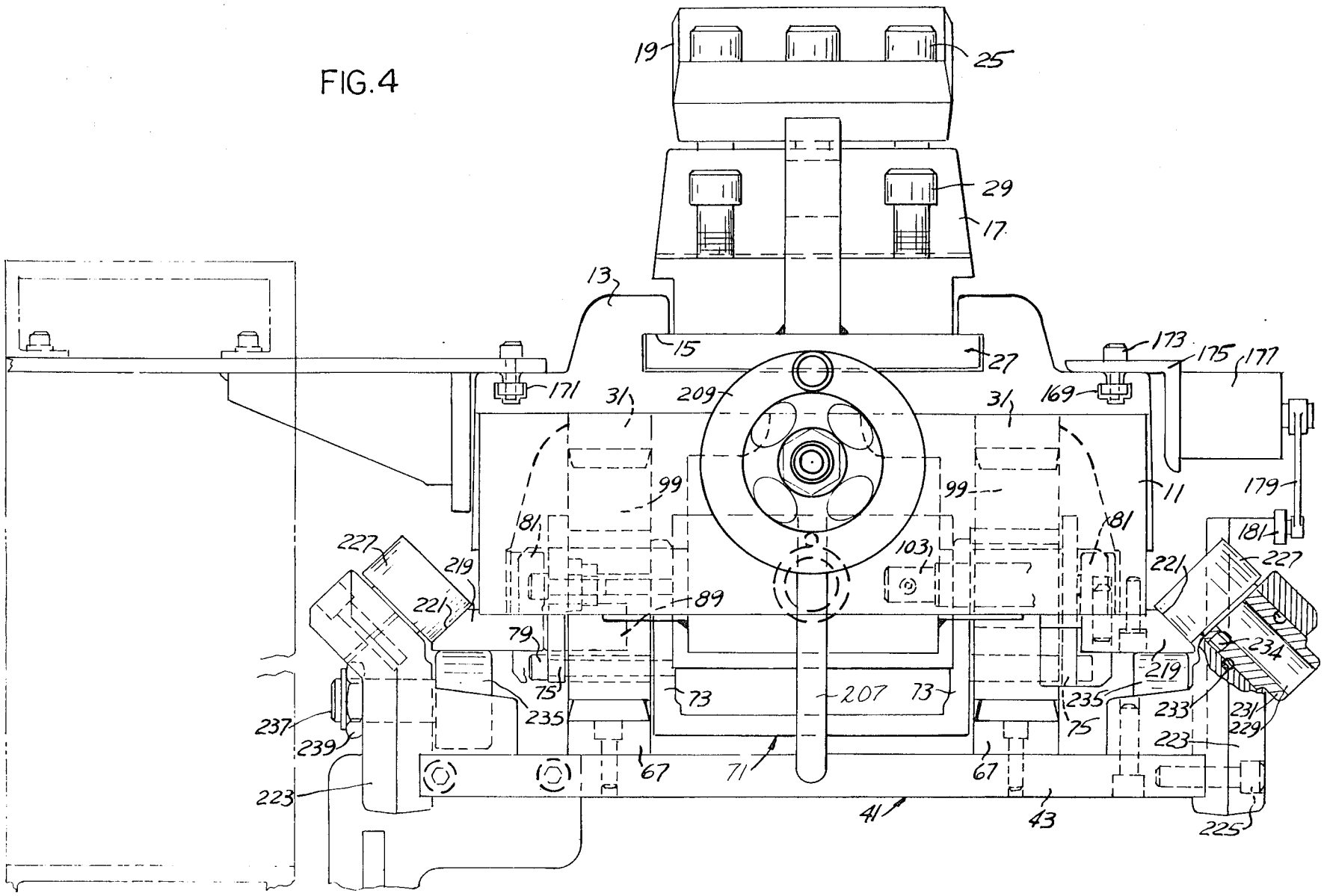
FIG. 4 is an end elevational view of a modified carrier mechanism.

As shown in FIG. 4, there is shown an opposed pair of spaced tracks 219 instead of the tracks 37 of rectangular cross-section, FIGS. 1, 2 and 3. Here upon the exterior sides of the tracks 219 are downwardly and outwardly inclined track surfaces 221 extending at a 45 degree angle to the horizontal.

Replacing the above described bearing blocks 45 of FIGS. 1, 2 and 3, there is shown a modified bearing block 223 in FIG. 4 secured to carriage plate 43 by fasteners 225.

Within each of the longitudinally spaced opposed pairs of bearing blocks 223 there is mounted a cam follower 227 journaled upon shaft 229 which is inclined on a 45° axis to the horizontal. Said shaft is journaled within the eccentric bushing 231 held in place upon said bearing block by anchor pin 233. A suitable set screw 234 retains shaft 229 within said bushing. Accordingly, the angular cam followers 227, arranged in pairs at opposite ends of the carriage plate 43, bear against the inclined surfaces 221 of the corresponding tracks 219 for movement therealong.

Additionally there is provided upon each of the bearing blocks 223 an additional cam follower 235 which bears against the undersurface of track 219 and is journaled upon shaft 237 on a horizontal axis which extends through the bearing block and is secured thereto by fastener 239.

Thus, the corresponding cam followers 227 and 235 operatively engage corresponding surfaces of the tracks 219 for constraining the carriage plate 43 to longitudinal reciprocal movements in unit horizontal and vertical planes respectively.

In this construction, the pinion carrier mounts longitudinally spaced laterally opposed cam followers 81 which are mounted upon opposite sides of the pinion carrier and supportably bear against top surfaces of the tracks 219 in the same manner as above described.

Additional longitudinally spaced opposed pairs of cam followers 89 are mounted upon the pinion carrier and journaled upon vertical axes adapted for cooperative guided engagement with the interior upright surfaces of the corresponding tracks 219.

The respective pinions 99 upon the pinion carriers, FIGS. 1 through 4, have even numbers of pitched teeth so that the short rack gears 67 upon the carriage plate 43 are transferred longitudinally from one pair of opposed pinions to another pair of opposed pinions. This eliminates any overhanging rack on the carriage. Pinion carrier 71 has an important improvement with its upwardly opening channel shape and inner and outer upright side plates for receiving and mounting the corresponding pinions 99 and employing suitable spacers between the pinion side plates.

The corresponding laterally spaced pairs of cam followers 81, 89 upon opposite sides of the pinion carrier accurately position the pinion carrier in relation to the stationary rack gears 31 upon body 13. Through a machined slot in each of the pinion carrier slide plates, there is mounted another bearing assembly or cam follower 99 adapted for operative engagement with side wall portions of the tracks 37. These cam followers are accurately positioned with respect to the inner surfaces of the tracks making up a completely trapped pinion carrier assembly.

The pinion carrier assembly is movable forwardly and rearwardly guided in both directions by rolling cam followers allowing the transfer unit to be positioned in any vertical, angular or horizontal position without creating undue stress or having moving members creating a rubbing friction.

In this assembly only one set of laterally spaced pinions are in contact between the stationary rack gears 31 and the moving rack gears 67 when transferring from pinion to pinion.

There is provided an accurately positioned centerline of the cam followers relative to the stationary rack gears 31, with the cam followers maintaining a roller movement upon the tracks 37. The additional cam followers upon the pinion carrier maintain a center horizontal positioning of the carrier allowing it to be positioned horizontally, vertically or angularly with a free rolling forward and retracting movement with respect to the tracks with no sliding friction.

The corresponding cam followers upon the bearing blocks of the carriage include cam followers which bear against the top and bottom of the tracks for maintaining any desired eccentric position and eliminating any vertical variation of the rectilinear path of carrier movement.

The horizontal positioning of the carriage is furthermore accomplished by the additional sets of cam rollers eliminating any transverse horizontal movements of the carriage for maintaining horizontal accuracy of the carriage assembly relative to the body and track assemblies.

In the present stroke multiplying mechanism, by using a stationary rack gear coupled to a moving rack gear with intermediate pinions, the carriage motion is double the cylinder rod stroke. Similarly, the carriage force is fifty percent of the cylinder rod force pressure. In the present construction, double pinions upon the pinion carrier are in contact with the stationary rack gears on the body and the moving rack gears on the carriage. This greatly increases rack life and pinion life when heavy loads are carried by the carriage. The loaded carriage is brought against the shock absorber in order that the kinetic energy may be absorbed to bring the carriage to a decelerated smooth stop.

In the embodiment disclosed showing a pulley carrier, as the cylinder rod advances the pulley carrier assembly moves forward causing the carriage into which the timing belts are fastened to move twice the speed of the piston rod. While the pulleys and timing belts or the equivalent use of cables eliminates the rack gears and pinions, such construction lacks the ruggedness thereof.

Having described my invention, reference should now be had to the following claims:

I claim:

1. In a multiple stroke retractor mechanism for article transfer apparatus having an elongated body having a central longitudinal axis suspended from a support, a pair of parallel spaced tracks depending from, projecting laterally outward of and secured to said body along its length upon opposite sides of said axis, a continuously reciprocal carriage adapted to mount an article gripping tool underlying and guidably mounted upon said tracks for reciprocal movements, a pair of depending laterally spaced first racks upon said body along its length, a pair of laterally spaced second racks upon said carriage along its length opposed to said first racks, a reciprocal pinion carrier between said body and carriage for driving said carriage including longitudinally spaced laterally opposed pairs of pinions in mesh with and interconnecting said first and second racks respectively, a power means upon said body connected to and reciprocating said pinion carrier;

the improvement comprising said pinion carrier being continuously reciprocal and including an elongated upwardly opening channel having opposed first side plates;

said pairs of pinions being journaled upon said side plates;

longitudinally spaced laterally opposed pairs of first cam followers extending outwardly of, journaled upon said channel upon horizontal axes and supportably mounted upon said tracks, respectively, constraining reciprocal movements of said pinion carrier to a single horizontal plane; and longitudinally spaced laterally opposed pairs of second cam followers extending outwardly of and journaled upon said channel upon vertical axes and retainingly engaging the inner sides of said tracks respectively, constraining the reciprocal movements of said pinion carrier to a single vertical plane.

2. In the pinion carrier of claim 1, second side plates respectively mounted outwardly of, parallel to and secured to said first side plates;

said pairs of pinions being interposed between and journaled upon said first and second side plates, said first cam followers being journaled upon said second side plates respectively;

said second cam followers being journaled upon said second side plates.

3. In the pinion carrier of claim 1, the mounting of said carriage including an elongated carriage plate underlying and extending outwardly of said tracks;

longitudinally spaced laterally opposed pairs of bearing blocks mounted upon opposite sides of said carriage plate adjacent its ends and secured thereto;

the tracks being rectangular in cross-section;

each bearing block having an inwardly opening recess receiving said tracks respectively;

and a plurality of right angularly related roller means within each bearing block upon a corresponding plurality of right angularly related axes for operative retaining engagement with the top, bottom and outer edge of said tracks respectively;

4. In the pinion carrier of claim 3, said roller means including opposed spaced pairs of first and second cam followers within and journaled upon said bearing block on spaced horizontal axes, bearing upon and retainingly engaging the top and bottom of said track, constraining said carriage to reciprocal movements in a single horizontal plane;

and a third cam follower within and journaled upon said bearing block on a vertical axis retainingly engaging the outer edge of said track, constraining reciprocal movements of said carriage to a single vertical plane.

5. In the pinion carrier of claim 4, said body including a pair of laterally spaced side walls;

each track having a central longitudinal recess along its length receiving said body side walls and secured thereto;

a portion of said tracks extending outwardly of said body receiving said first and second bearing block cam followers;

a portion of said track extending inwardly of said body side walls receiving said first and second cam rollers upon said pinion carrier.

6. In the pinion carrier of claim 1, longitudinally spaced laterally opposed pairs of additional cam followers outwardly of and journaled upon said channel bearing against the undersurfaces of said tracks respectively.

7. In the pinion carrier of claim 1, said tracks having flat right angularly related top, bottom, and inner walls and outer wall inclined downwardly and outwardly at a 45° angle;

the mounting of said carriage including an elongated carriage plate underlying and extending outwardly of said tracks;

longitudinally spaced opposed pairs of bearing blocks upon opposite sides of said carriage plate adjacent its ends and secured thereto;

said bearing blocks having an inwardly opening recess receiving said tracks respectively and;

roller means upon said bearing blocks in registry with said tracks;

said roller means including spaced opposed pairs of first and second cam followers within and journaled upon each bearing block, said first cam followers being rotatable on axes inclined at 45° to the horizontal and bearing against said track inclined wall;

and said second cam followers being rotatively mounted on horizontal axes and bearing against the top and bottom surface of said track, for constraining said carriage to reciprocal movements in single horizontal and vertical planes.

8. In a multiple stroke retractor mechanism for article transfer apparatus having an elongated body having a central longitudinal axis suspended from a support, a pair of parallel spaced tracks depending from, projecting laterally outward of and secured to said body along its length upon opposite sides of said axis, a continuously reciprocal carriage adapted to mount an article gripping tool underlying and guidably mounted upon said tracks, a reciprocating carrier between said body and carriage guidably mounted upon said body for driving said carriage, and a power means upon said body connected to and reciprocating said carrier;

the improvement comprising said pinion carrier being continuously reciprocal and including an elongated upwardly opening channel having opposed first side plates;

longitudinally spaced laterally opposed pairs of first cam followers extending outwardly of and journaled upon said channel upon horizontal axes and supportably mounted upon said tracks respectively, constraining reciprocal movements of said carrier to a single horizontal plane;

drive means interconnecting said carrier and carriage whereby reciprocal movements of said carrier effects corresponding reciprocal movements of said carriage; and longitudinally spaced laterally opposed pairs of second cam followers extending outwardly of and journaled upon said channel upon vertical axes and retainingly engaging the sides of said tracks respectively, constraining the reciprocal movements of said carrier to a single vertical plane.

9. In the multiple stroke retractor of claim 8, longitudinally spaced laterally opposed pairs of additional cam followers extending outwardly of and journaled upon said channel retainingly bearing against the undersurfaces of said tracks respectively.

10. In the retractor mechanism of claim 8, the drive means interconnecting said carrier and carriage including longitudinally spaced laterally opposed pairs of pulleys journaled upon said carrier adjacent its opposite ends;

and continuous timing belts on opposite sides of said carrier, mounted upon and around said pulleys respectively, one of said belts being secured to said carriage and the other of said belts being secured to said body whereby reciprocal movements of said carrier effects corresponding reciprocal movements of said carriage.

* * * * *